US008217923B2

(12) United States Patent
Matsui

(10) Patent No.: US 8,217,923 B2
(45) Date of Patent: Jul. 10, 2012

(54) DATA DRIVER FOR DISPLAY DEVICE, TEST METHOD AND PROBE CARD FOR DATA DRIVER

(75) Inventor: Tadayoshi Matsui, Shiga (JP)

(73) Assignee: Renesas Electronics Corporation, Kawasaki, Kanagawa (JP)

( * ) Notice: Subject to any disclaimer, the term of this patent is extended or adjusted under 35 U.S.C. 154(b) by 1036 days.

(21) Appl. No.: 12/216,611

(22) Filed: Jul. 8, 2008

(65) Prior Publication Data

US 2009/0015572 A1 Jan. 15, 2009

(30) Foreign Application Priority Data

Jul. 9, 2007 (JP) ..... 2007-180083

(51) Int. Cl.
*G09G 5/00* (2006.01)

(52) U.S. Cl. ..... 345/204; 345/208; 345/98; 345/99; 345/100; 324/512; 324/522; 324/527; 349/54; 349/192

(58) Field of Classification Search ..... 345/204, 345/208, 98–100; 324/512, 522, 535, 527, 324/565.03, 760.01, 760.02; 327/526; 349/54, 349/55, 139, 192
See application file for complete search history.

(56) References Cited

U.S. PATENT DOCUMENTS

| | | | | |
|---|---|---|---|---|
| 7,432,904 | B2 * | 10/2008 | Kang | 345/98 |
| 2003/0184568 | A1 * | 10/2003 | Date et al. | 345/690 |
| 2005/0122300 | A1 * | 6/2005 | Makuuchi et al. | 345/95 |
| 2005/0264510 | A1 * | 12/2005 | Shimatani | 345/94 |
| 2006/0125754 | A1 * | 6/2006 | Rao et al. | 345/93 |
| 2007/0067693 | A1 * | 3/2007 | Okuzono et al. | 714/742 |
| 2008/0094385 | A1 * | 4/2008 | Tazuke | 345/211 |

FOREIGN PATENT DOCUMENTS

JP 8-171081 7/1996

* cited by examiner

*Primary Examiner* — Lun-Yi Lao
*Assistant Examiner* — Priyank Shah
(74) *Attorney, Agent, or Firm* — McGinn IP Law Group, PLLC

(57) ABSTRACT

A data driver of a display device includes: a DAC (Digital Analog Converter) outputting a drive signal for driving a signal line of a displaying unit; an amplifier amplifying the drive signal outputted by the DAC and outputting the drive signal to the signal line; a repair amplifier having an input and an output, wherein the signal line is separated by a breakage point into a connected data line connected to the amplifier and a disconnected data line not connected to the amplifier, and the input of the repair amplifier is connected to the connected data line and the output of the repair amplifier is connected to the disconnected data line; and a switch supplying the drive signal to the input of the repair amplifier for testing the repair amplifier. An output delay test for the repair amplifier can be performed under a condition similar to that of the amplifier.

19 Claims, 8 Drawing Sheets

DATA DRIVER FOR DISPLAY DEVICE, TEST METHOD AND PROBE CARD FOR DATA DRIVER

INCORPORATION BY REFERENCE

This patent application is based on Japanese Patent Application No. 2007-180083. The disclosure of the Japanese Patent Application is incorporated herein by reference.

BACKGROUND OF THE INVENTION

1. Field of the Invention

The present invention relates to a data driver of a display device, a test method and a probe card for the data driver and, more particularly, to a technique suitable for testing a repair amplifier of a data driver.

2. Description of Related Art

Flat panel displays become widely used in recent years. There are various types of flat display panels such as the TFT (abbreviating "a Thin Film Transistor") type liquid crystal display device, the simple matrix type liquid crystal display device, the electroluminescence (abbreviated as "EL") display device and the plasma display device. On a display (i.e., a screen) of the display device, display data are displayed. In the following, the TFT type liquid crystal display is used as an example for explanation.

FIG. 1 illustrates a configuration of a TFT type liquid crystal display device 1.

The TFT type liquid crystal display device 1 is provided with a glass substrate 3, a display part (i.e., a liquid crystal panel) 10, first to m-th m gate lines G1 to Gm and first to n-th n data lines D1 to Dn. The liquid crystal panel 10 has a plurality of pixels 11 arranged in a matrix on the glass substrate 3. For example, (m×n) numbers of pixels 11 are arranged on the glass substrate 3 (here, m and n each are an integer of 2 or more indicating the numbers of the rows and the columns of the matrix, respectively). Each of the m×n pixels 11 includes a thin film transistor (abbreviated as a "TFT") 12 and a pixel capacitor 15. The pixel capacitor 15 includes a pixel electrode and an opposite electrode disposed opposite to the pixel electrode. The TFT 12 is provided with a drain electrode 13, a source electrode 14 connected to the pixel electrode and a gate electrode 16. Each of the m gate lines G1 to Gm is connected to the gate electrode 16 of the TFT 12 in the pixel 11 in the m-th row. Each of the n data lines D1 to Dn is connected to the drain electrode 13 of the TFT 12 in the n-th pixel 11 in the n-th column.

The TFT type liquid crystal display device 1 is further provided with a gate driver 20 and a data driver 30. The gate driver 20 is mounted on a chip, not illustrated, and is connected to one end of each of the m gate lines G1 to Gm. In the meantime, the data driver 30 is mounted on the chip, and is connected to one end of each of the n data lines D1 to Dn.

The TFT type liquid crystal display device 1 is still further provided with a timing controller 2. The timing controller 2 supplies a gate clock signal GCLK for use in selecting a gate line G1 in, for example, one horizontal period of time to the gate driver 20. The gate driver 20 outputs a selection signal to the gate line G1 in response to the gate clock signal GCLK. At this time, the selection signal is transmitted to the gate line G1 from one end to the other end in this order, and then, the TFTs 12 of the (1×n) pixels 11 corresponding to the gate line G1 are turned on in response to the selection signal supplied to the gate electrode 16.

Moreover, the timing controller 2 supplies a clock signal CLK and one line display data DATA for the display of one line to the data driver 30. The one line display data DATA includes n pieces of display data corresponding to the data lines D1 to Dn respectively. The data driver 30 outputs the n pieces of display data to the n data lines D1 to Dn, respectively, in response to the clock signal CLK. At this time, the TFTs 12 of the (1×n) pixels 11 corresponding to the gate line G1 and the n data lines D1 to Dn are turned on. As a consequence, the n pieces of display data are written in the pixel capacitors 15 in the (1×n) pixels 11, respectively, to be stored till next writing. In this manner, the n pieces of display data are displayed as the one line display data DATA.

FIG. 2 illustrates a configuration of the data driver 30. The data driver 30 is cascaded in a columnar direction from first to x-th in this order. Here, x is an integer of 2 or more.

The data driver 30 is provided with a shift register 31, a data register 32, a latch circuit 33, a level shifter 34, a DAC (abbreviating "a Digital to Analog Converter) 35, an amplifier circuit 36 and a gray-scale voltage generation circuit 37.

The gray-scale voltage generation circuit 37 includes a plurality of gray-scale correction resistor elements, not illustrated, connected in series. The gray-scale voltage generation circuit 37 divides a reference voltage supplied from a power source circuit, not illustrated, into a plurality of gray-scale voltages by the plurality of gray-scale correction resistor elements. For example, in a case where an image is displayed with a 64-level gray-scale in the TFT type liquid crystal display device 1, the gray-scale voltage generation circuit 37 divides reference voltages V0 to V7 into positive gray-scale voltages with the 64-level gray-scale as the plurality of gray-scale voltages by 63 gray-scale correction resistor elements R0 to R62. The same goes for negative gray-scale voltages.

The shift register 31 includes n shift registers, not illustrated. The data register 32 includes n data registers, not illustrated. The latch circuit 33 includes n latch circuits, not illustrated. The level shifter 34 includes n level shifters, not illustrated.

The DAC 35 includes n DACs (see FIG. 3). The n DACs each include a P type converter PchDAC for outputting the positive gray-scale voltage as an output gray-scale voltage and an N type converter NchDAC for outputting the negative gray-scale voltage as another output gray-scale voltage. For example, odd-numbered DACs out of the n DACs are assumed to be PchDACs whereas even-numbered DACs are assumed to be NchDACs. The DAC 35 further includes n switch elements for reversely driving, that is, output switching by alternately applying the positive gray-scale voltage and the negative gray-scale voltage to the pixel 11 (see FIG. 3). The amplifier circuit 36 includes n amplifiers 36-1 to **36-*n* (see FIGS. 2 and 3**).

Next, an operation of the TFT type liquid crystal display device 1 will be described below.

For example, the timing controller 2 supplies the clock signal CLK and the one line display data DATA to the x data drivers 30, and further, supplies a shift pulse signal STH to the first data driver 30. Each of the x data drivers 30 outputs the n pieces of display data included in the one line display data DATA to the n data lines D1 to Dn, respectively, in response to the clock signal CLK and the shift pulse signal STH.

In the i-th (here, i=1, 2, . . . and x−1) data driver 30, the n shift registers in the shift register 31 sequentially shift the shift pulse signal STH in synchronization with the clock signal CLK, and then, outputs it to the n data registers in the data register 32. The n-th shift register in the shift register 31 outputs the shift pulse signal STH to the n-th data register in the data register 32, and further, outputs it to an (i+1)th (here, i=1, 2, . . . and x−1) data driver 30 (i.e., cascade-output). In the x-th data driver 30, the n shift registers in the shift register 31 sequentially shift the shift pulse signal STH in synchronization with the clock signal CLK, and then, outputs it to the n data registers in the data register 32.

In each of the x data drivers 30, the n data registers in the data register 32 get the n pieces of display data supplied from the timing controller 2 in synchronization with the shift pulse signals STH outputted from the n shift registers in the shift register 31, respectively, and then, output them to the latch circuit 33. The n latch circuits in the latch circuit 33 latch the n pieces of display data supplied from the n data registers in the data register 32 at the same timing, respectively, and then, output them to the level shifter 34. The n level shifters in the level shifter 34 subject the n pieces of display data to level shifting, respectively, and then, output them to the DAC 35. In the DAC 35, the n DACs perform digital/analog-conversion of the n pieces of display data supplied from the n level shifters in the level shifter 34, respectively, and then, the n switch elements switch the outputs.

As illustrated in FIG. 3, for example, the odd-numbered (first, third, . . . and (n−1)th) PchDACs select, from the positive gray-scale voltages with the 64-level gray-scale, output gray-scale voltages in accordance with the pieces of display data outputted from the odd-numbered (first, third, . . . and (n−1)th) level shifters, and then, output them to the odd-numbered amplifiers 36-1, 36-3, . . . and 36-(*n*−1) in the amplifier circuit 36 via the odd-numbered (first, third, . . . and (n−1)th) switching elements, respectively. In this case, the even-numbered (second, fourth, . . . and n-th) NchDACs select, from the negative gray-scale voltages with the 64-level gray-scale, output gray-scale voltages in accordance with the pieces of display data outputted from the even-numbered (second, fourth, . . . and n-th) level shifters, and then, output them to the even-numbered amplifiers 36-2, 36-4, . . . and 36-*n* in the amplifier circuit 36 via the even-numbered (second, fourth, . . . and n-th) switching elements, respectively.

In contrast, in a case of the reverse driving, as illustrated in FIG. 3, the odd-numbered (first, third, . . . and (n−1)th) PchDACs select, from the positive gray-scale voltages with the 64-level gray-scale, output gray-scale voltages in accordance with the pieces of display data outputted from the odd-numbered (first, third, . . . and (n−1)th) level shifters, and then, output them to the even-numbered amplifiers 36-2, 36-4, . . . and 36-*n* in the amplifier circuit 36 via the odd-numbered (first, third, . . . and (n−1)th) switching elements, respectively. In this case, the even-numbered (second, fourth, . . . and n-th) NchDACs select, from the negative gray-scale voltages with the 64-level gray-scale, output gray-scale voltages in accordance with the pieces of display data outputted from the even-numbered (second, fourth, . . . and n-th) level shifters, and then, output them to the odd-numbered amplifiers 36-1, 36-3, . . . and 36-(*n*−1) in the amplifier circuit 36 via the even-numbered (second, fourth, . . . and n-th) switching elements, respectively.

As a consequence, the DAC 35 outputs, to the amplifier circuit 36, the n output gray-scale voltages subjected to the digital/analog conversion and the output switching over. The n amplifiers 36-1 to 36-*n* in the amplifier circuit 36 input the n output gray-scale voltages, respectively, and then, output them to the n data lines D1 to Dn.

For the display panel (exemplified by the liquid crystal panel 10) as described above, high precision is required, so that the width of the signal line such as the gate lines G1 to Gm and the data lines D1 to Dn has been reduced. As a result, the possibility of breakage caused by foreign matters in a fabricating process or deficiency in a lithographic process bas been becoming high. If a signal line is broken when the driver outputs the drive signal for driving the signal line, the pixels arranged forward of the broken portion cannot be driven. For example, it is assumed that a driver is represented by the above-described data driver 30, and the signal lines are represented by the above-described data lines D1 to Dn, the drive signal is represented by the above-described n output gray-scale voltages (i.e., the n pieces of display data) and a data line Dj (here, j is an integer satisfying an expression: $1 \leqq j \leqq n$) is broken, the pixels 11 arranged forward of the broken portion cannot be driven. In this case, the display device results in a defective device. One can find this deficiency only when an electric test is conducted at the final stage at which the panel is fabricated and the driver, the substrate and the like are connected and assembled, so that a vast cost occurs when a deficiency is found out.

To tackle the problem, in the technique disclosed in Japanese Laid-Open Patent Application JP-A-Heisei, 8-171081, a repair circuit (also referred to as a rescue circuit) is disposed in a driver in advance, so that pixels arranged forward of a broken portion are driven via the repair circuit when a breakage is found. In the following, this technique will be simply explained by using the example of the TFT type liquid crystal display device 1 described above.

As illustrated in FIG. 4, the data driver 30 in the TFT type liquid crystal display device 1 is further provided with a repair amplifier 40. The repair amplifier 40 is illustrated independently of the data driver 30 for the sake of convenience of explanation. The repair amplifier 40 is mounted on a chip, and includes, for example, two repair amplifiers 40-1 and 40-2. The TFT type liquid crystal display device 1 is further provided with auxiliary interconnections 41 and 42 mounted on the glass substrate 3.

In the case where breaking 43 is found on a data line Dj, a part of the data line Dj still connected to the amplifier 36-*j*, which is represented by Dj' (referred to as a connected data line), and the auxiliary interconnection 41 are connected at their intersectional position. Moreover, the auxiliary interconnection 41 is connected to an input of the repair amplifier 40-1 at their intersectional position 45. Additionally, an output of the repair amplifier 40-1 is connected to the auxiliary interconnection 42 at their intersectional position 46. Furthermore, the auxiliary interconnection 42 is connected to a part of the data line Dj not connected to the amplifier 36-*j*, which is represented by Dj" (referred to as a disconnected data line) at their intersectional position 47. Consequently, a repair circuit is constructed of a channel consisting of an output of the amplifier 36-*j*, the connected data line Dj', the intersection 44, the auxiliary interconnection 41, the intersection 45, the repair amplifier 40-1, the intersection 46, the auxiliary interconnection 42, the intersection 47 and the not-connected data line Dj". Through the repair circuit, the pixels 11 arranged forward of the breaking 43 can be driven. Here, the repair amplifier 40-1 is used for compensating the decrease of driving performance due to a resistance of the repair circuit.

During an electric characteristics inspection of a display driver IC having the repair circuit, an electric characteristics inspection for the repair amplifiers 40-1 and 40-2 is also conducted in addition to other electric characteristics inspections.

As illustrated in FIG. 5, the data driver 30 in the TFT type liquid crystal display device 1 is further provided with a pad for conducting the electric characteristics inspections. The pad is mounted on the chip.

The pad includes output pads 56-1 to 56-*n*, repairing input pads 51-1 and 51-2 and repairing output pads 52-1 and 52-2. The output pads 56-1 to 56-*n* are connected to outputs of the n amplifiers 36-1 to 36-*n* in the amplifier circuit 36, respectively. The repairing input pads 51-1 and 51-2 are connected to inputs of the repair amplifiers 40-1 and 40-2, respectively. The repairing output pads 52-1 and 52-2 are connected to outputs of the repair amplifiers 40-1 and 40-2, respectively.

At the time of an electric characteristics inspection, a measurement equipment 53 is connected to the chip. The measurement equipment 53 includes a probe card 54 and a tester 55. As the tester 55, a mass-produced LSI tester can be used.

For example, at the time of an electric characteristics inspection, the measurement equipment 53 tests an output delay of each of the n amplifiers 36-1 to **36-*n* in the amplifier circuit 36. In this case, the probe card 54 inputs drive signals (i.e. the output gray-scale voltages) supplied to the output pads 56-1 to 56-*n* via the n amplifiers 36-1 to 36-*n* by the output switch by the DAC 35, and then, outputs the drive signals to the tester 55. The tester 55 tests the output delay of each of the n amplifiers 36-1 to 36-*n*** based on the drive signals, and then, determines the quality based on the output delay time representing the output delay. The quality is determined based on whether or not the output delay time is over a predetermined upper limit. For example, when the output delay time is below the upper limit, the result shows it is a good product: in contrast, when the output delay time is over the upper limit, the result shows it is a deficient product.

Moreover, as one of the electric characteristics inspections, the measurement equipment 53 tests an output delay of each of the repair amplifiers 40-1 and 40-2. In this case, the tester 55 supplies signals to the repairing input pads 51-1 and 51-2. The probe card 54 receives signals supplied to the repairing output pads 52-1 and 52-2 via the repair amplifiers 40-1 and 40-2, and then, outputs the signals to the tester 55. The tester 55 tests output delays of the repair amplifiers 40-1 and 40-2 based on the signals, respectively, and then, determines the quality based on the output delay time representing the output delay.

SUMMARY

However, in the case of performing an electric characteristics inspection of the repair amplifiers 40-1 and 40-2, there arises a problem that, when the quality of the output delay of the repair amplifiers 40-1, 40-2 is judged, the quality cannot be judged similarly to the output delay of the n amplifier 36-1 to **36-*n* in the amplifier circuit 36** because of the specifications of the tester.

In other words, in testing the output delays of the n amplifiers 36-1 to **36-*n*, the amplifiers 36-1 to 36-*n* input analogue voltages (output gray-scale voltages) from the DAC 35. Therefore, the quality of the output delay of each of the amplifiers 36-1 to 36-*n* need be judged with the characteristics at a time of the reception of the output switching input in the DAC 35. However, it is difficult to reproduce the output switch in the DAC 35 by the input from the mass-produced LSI tester 55, because of limitation of the ability or the cost of the tester 55**.

Furthermore, in some cases, there is a limitation of the maximum input analog voltage of the test device from the viewpoint of the cost of the mass-produced LSI tester 55. If the maximum is smaller than that of the analog voltage from the DAC 35, the quality of the delay time cannot be judged at a maximum input amplitude at which the delays of the repair amplifiers 40-1 and 40-2 are considered to be maximum.

That is to say, there arises a problem that the quality of the repair amplifiers 40-1 and 40-2 cannot be precisely determined by tests using mass-produced products.

In a first aspect of the present invention, a data driver of a display device includes: a DAC (Digital Analog Converter) configured to have an output to output a drive signal for driving a signal line of a displaying unit; an amplifier configured to amplify the drive signal outputted by the DAC and have an output to output the drive signal to the signal line; a repair amplifier configured to have an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line; and a switch configured to supply the drive signal to the input of the repair amplifier when a test mode for testing the repair amplifier is performed.

In another aspect of the present invention, in a test method for testing a data driver of a display device, the display device includes: a DAC (Digital Analog Converter) configured to have an output to output a drive signal for driving a signal line of a displaying unit; an amplifier configured to amplify the drive signal outputted by the DAC and have an output to output the drive signal to the signal line; and a repair amplifier configured to have an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line. The test method includes: connecting measurement equipment for testing the repair amplifier to the data driver based on an input of the input of the repair amplifier before performing a test mode; and supplying the drive signal to the input of the repair amplifier on the auxiliary amplifier when the test mode is performed.

In further another aspect of the present invention, in a probe card designed to be applied to a test of a data driver of a display device, the data driver includes: a DAC (Digital Analog Converter) configured to have an output to output a drive signal for driving a signal line of a displaying unit; an amplifier configured to amplify the drive signal outputted by the DAC and have an output to output the drive signal to the signal line; and a repair amplifier configured to have an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line. The probe card includes: a normal wiring; a testing wiring; and a switch. In a normal mode of the test, the switch connects the data driver and a tester for performing the test, connect an output of the amplifier and the tester to supply a signal from the output of the amplifier to the tester in a normal mode of the test. In a test mode of the test, the switch disconnect the output of the amplifier and the tester, connect the output of the amplifier and the input of the repair amplifier to supply a signal of the output of the repair amplifier based on the drive signal to the tester.

According to a data driver according to a display device of the present invention, when a test mode is conducted, the switches 60-1, 60-2 supply the drive signals (the output gray-scale voltages) to the inputs of the repair amplifiers 40-1, 40-2. As a consequence, an amplitude value of the analog voltage (the output gray-scale voltages) equivalent to that in the test of the output delay of the normal amplifiers 36, 36-1 to **36-*n* is inputted into the inputs of the repair amplifiers 40-1, 40-2. Therefore, the outputs of the repair amplifiers 40-1, 40-2 can be subjected to a test equivalent to that of the output delay of the amplifiers 36, 36-1 to 36-*n*. Thus, it is possible to precisely determine the quality with using a mass-produced LSI tester 55 based on the output delays of the repair amplifiers 40-1, 40-2**.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

Hereinafter, a data driver for display device, test method and probe for the data driver according to embodiments of the present invention will be described with reference to the attached drawings. Here, explanations of configurations and operations similar to those of the foregoing description (in description of the background art and summary of the invention) are abbreviated below.

(First Embodiment)

[Configuration]

Figure 1:
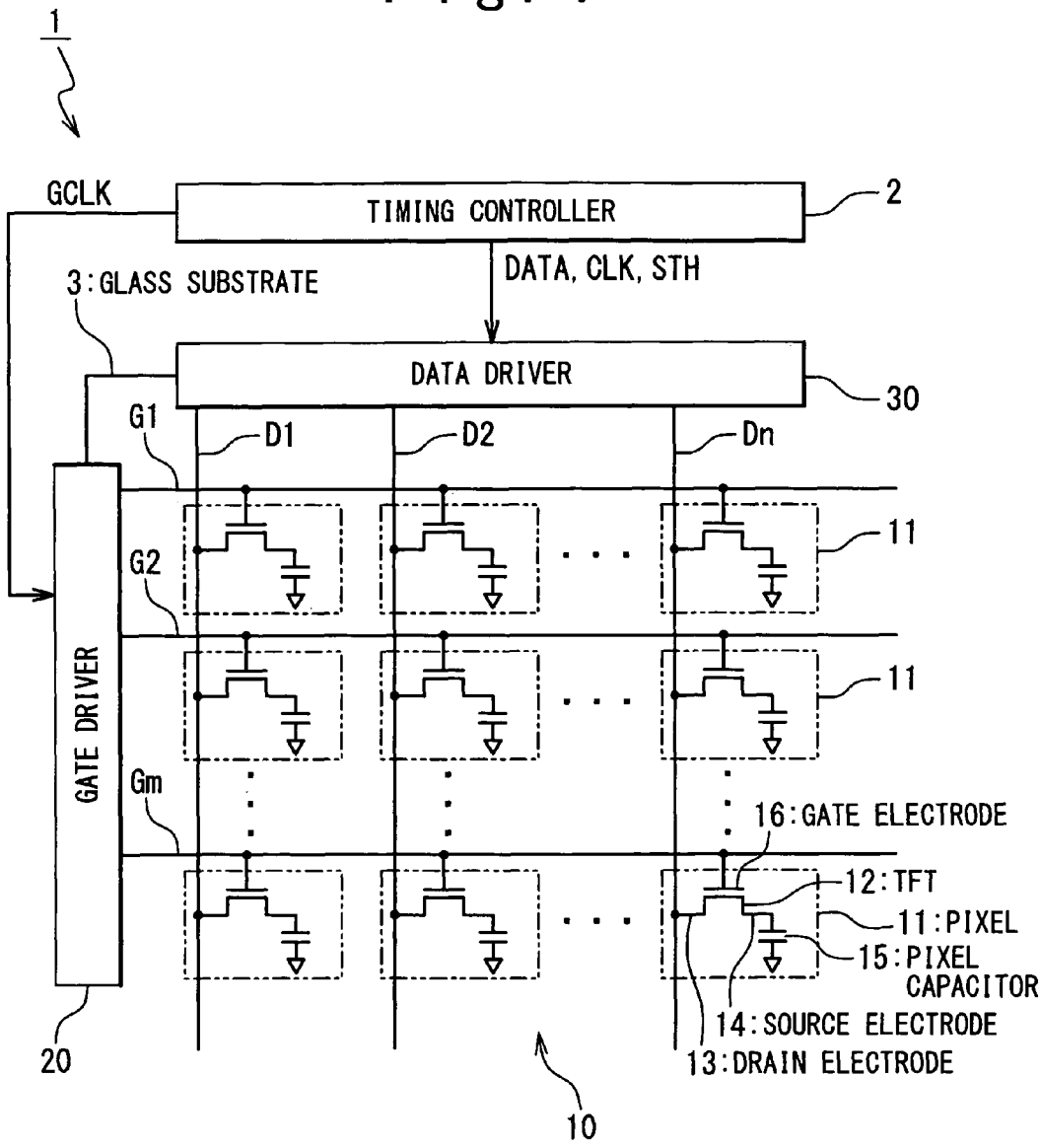
FIG. 1 illustrates a configuration of a TFT type liquid crystal display device in a related technique.
Figure 2:
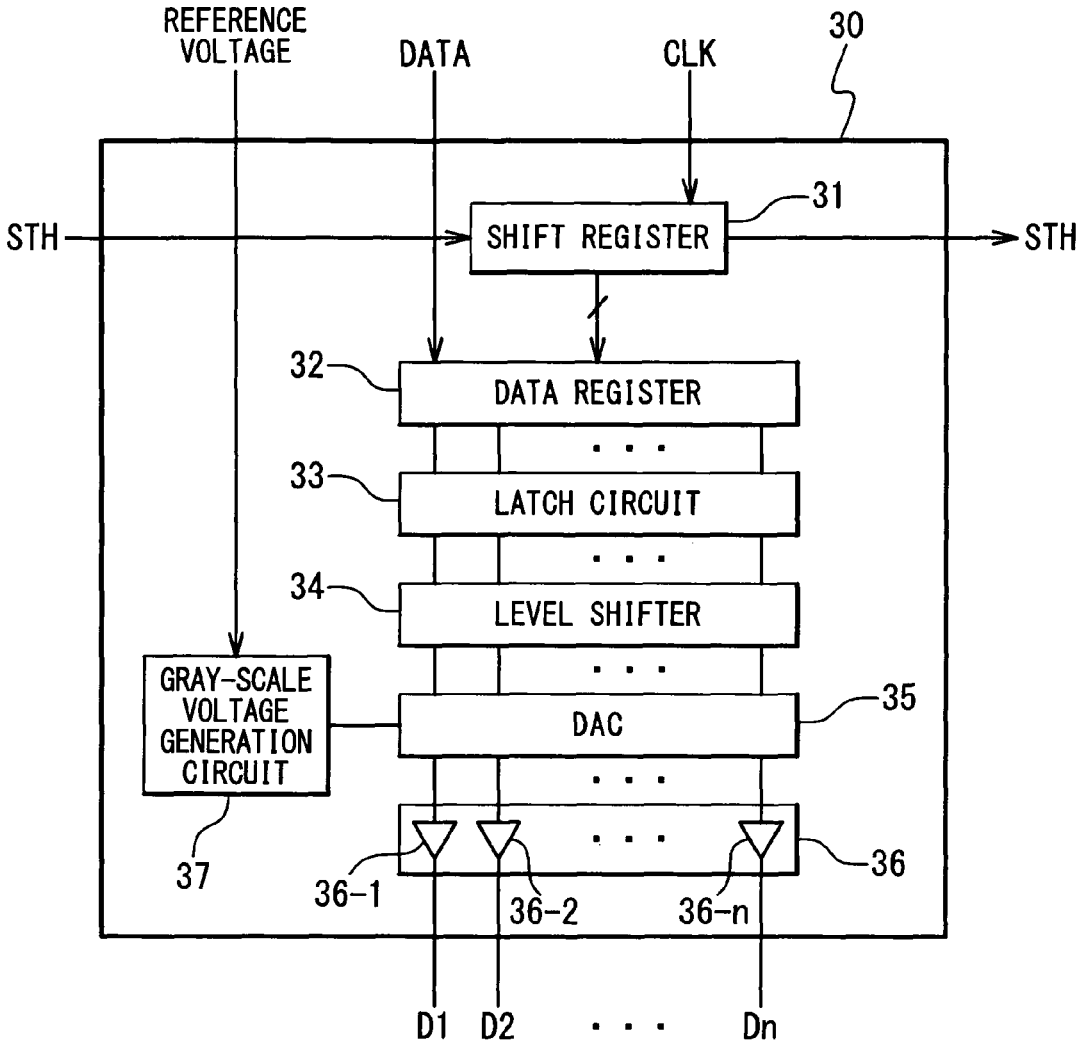
FIG. 2 illustrates a configuration of a data driver 30 in the TFT type liquid crystal display device in a related technique.
Figure 3:
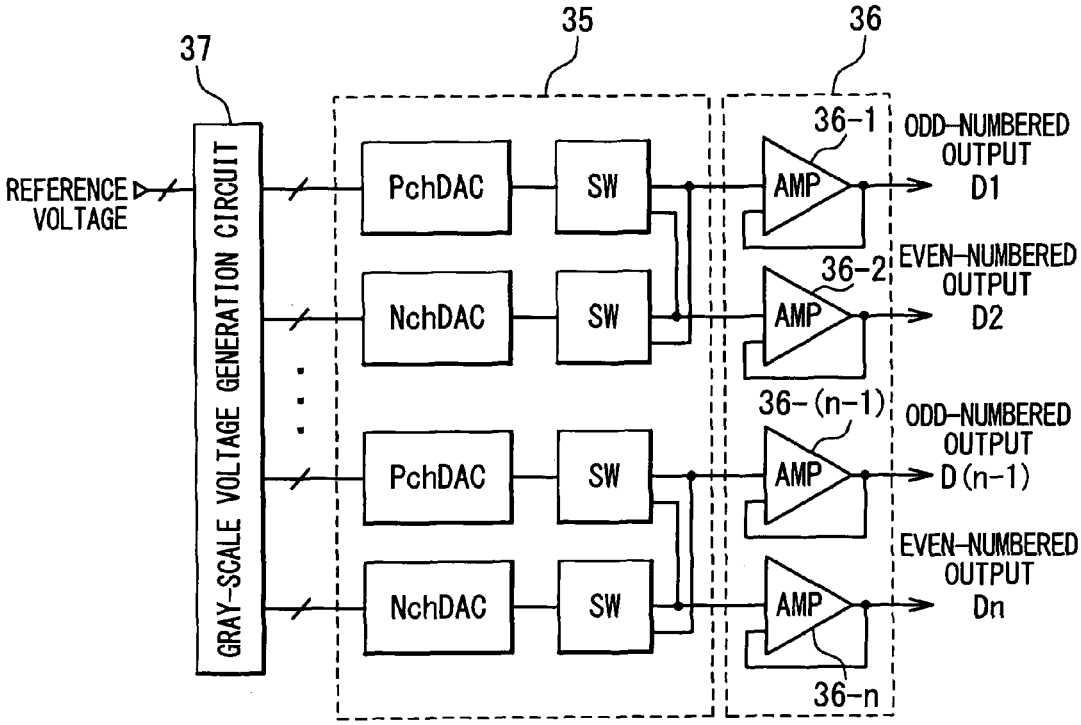
FIG. 3 illustrates a configuration of a DAC and an amplifier circuit 36 in the data driver 30 in a related technique.
Figure 4:
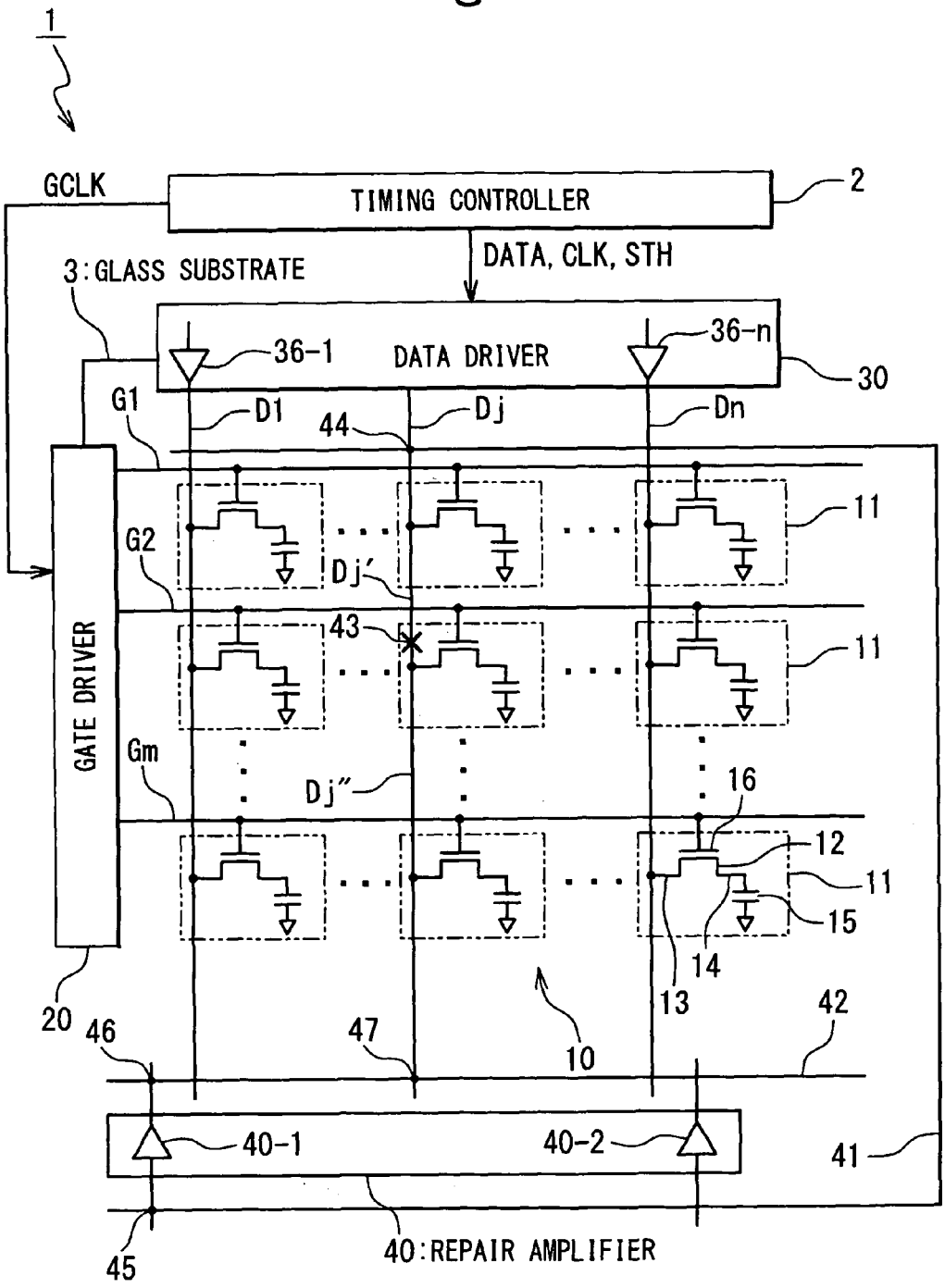
FIG. 4 is a diagram illustrating a repair circuit inside of the data driver 30 in a configuration of the TFT type liquid crystal display device in a related technique.
Figure 5:
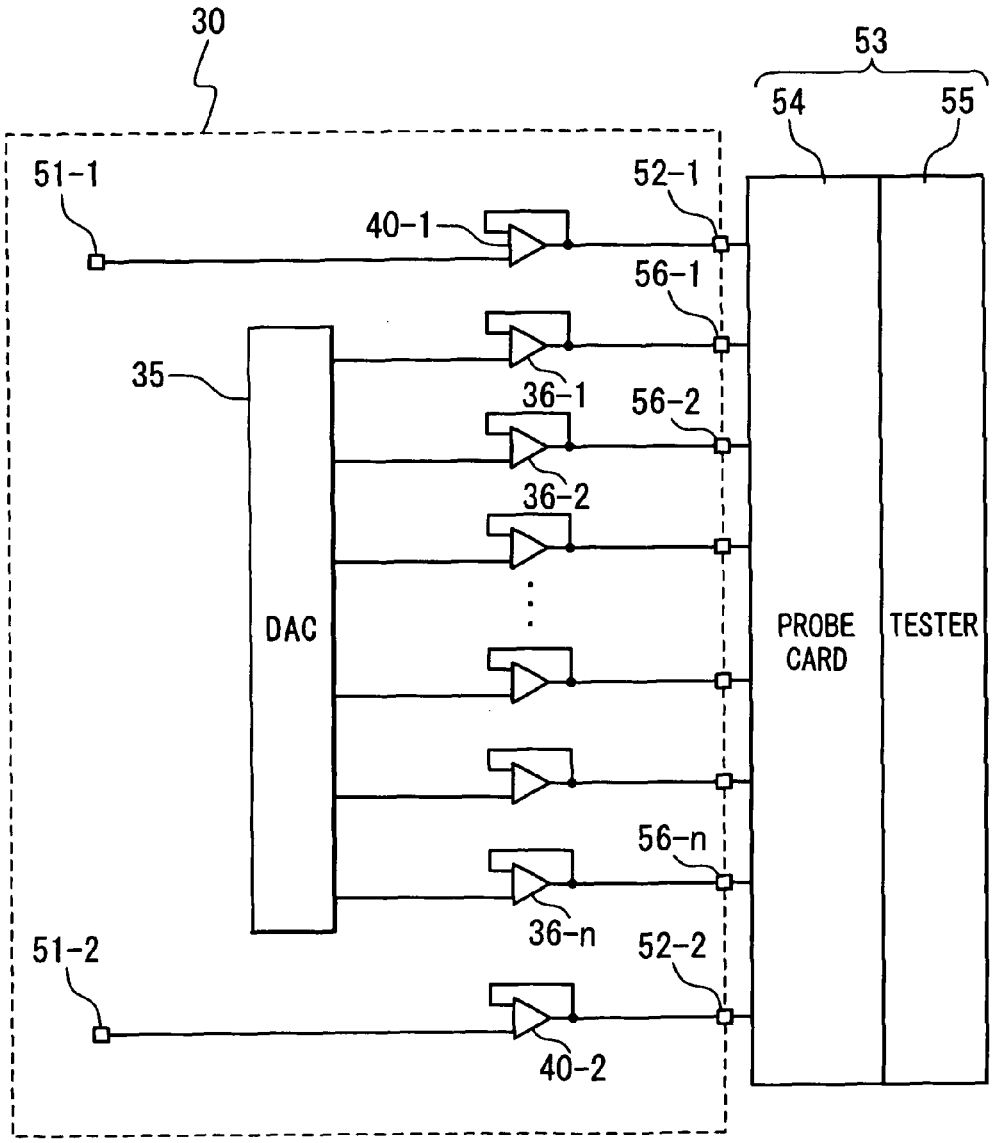
FIG. 5 illustrates a data driver 30 and measurement equipment 53, which is connected to the data driver 30 and includes a probe card 54 and a tester 55 in a related technique.
Figure 6:
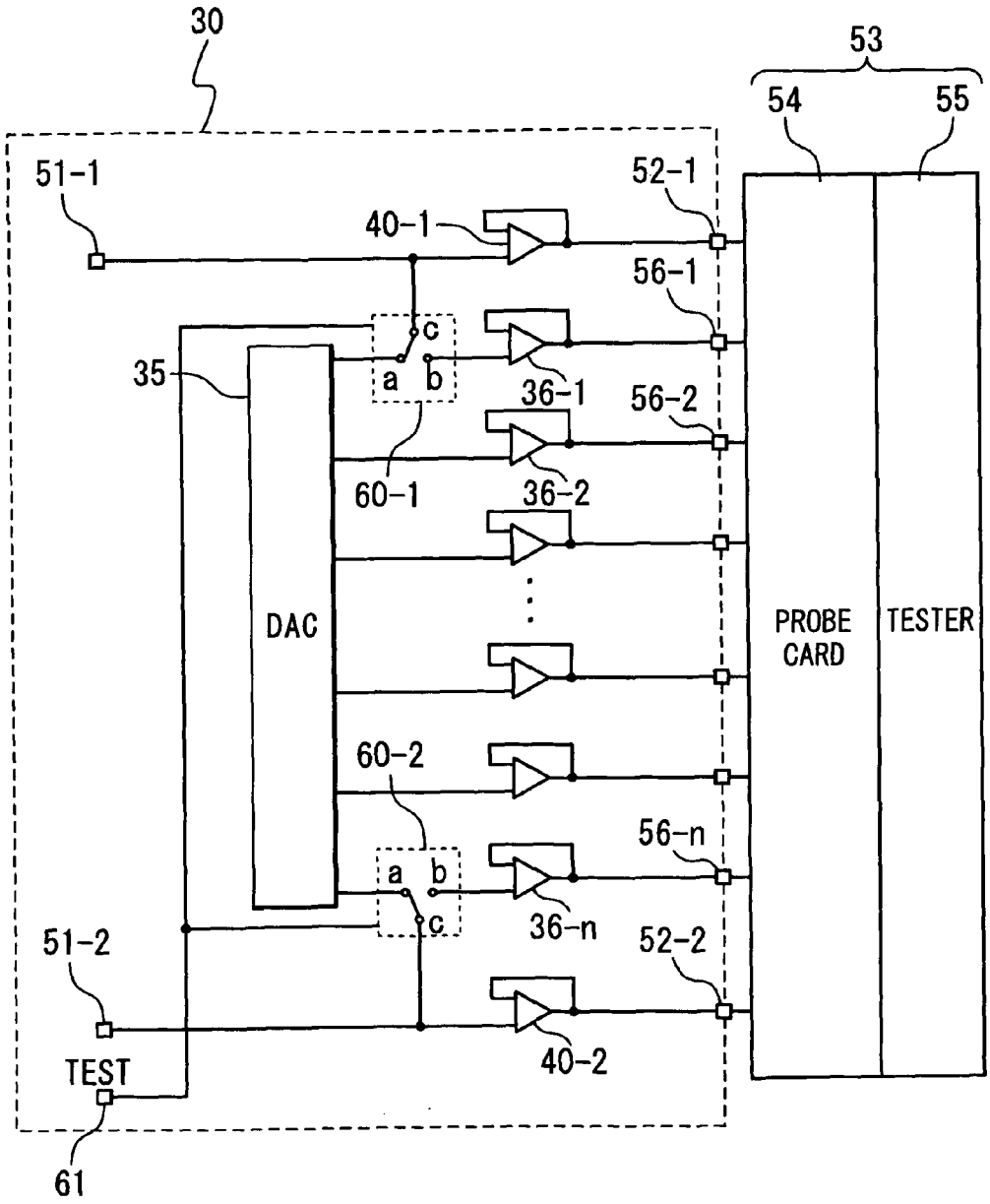
FIG. 6 illustrates a data driver 30 and measurement equipment 53, which is connected to the data driver 30 and includes a probe card 54 and a tester 55 according to a first embodiment.

FIG. 6 illustrates a configuration of a data driver 30 of a TFT type liquid crystal display device 1 and measurement equipment 53 which is connected to the data driver 30 and includes a probe card 54 and a tester 55 in a first embodiment according to the present invention. The data driver 30 is provided with switches 60-1 and 60-2 and a testing pad 61. The switches 60-1 and 60-2 and the testing pad 61 are mounted on a chip. The measurement equipment 53 including the probe card 54 and the tester 55 is connected to the chip when an electric characteristics inspection, described later, is conducted.

The testing pad 61 is connected to the switches 60-1 and 60-2 via wirings. Repair amplifiers 40-1 and 40-2 are disposed in respective vicinities of amplifiers 36-1 and **36-*n*, in an amplifier circuit 36 inside of the data driver 30. The switches 60-1 and 60-2 are interposed between a DAC 35 inside of the data driver 30 and the amplifiers 36-1 and 36-*n*, respectively. Each of the switches 60-1 and 60-2 includes a terminal "a" connected to an output of the DAC 35, a terminal "b" connected to an input of each of the amplifiers 36-1 and 36-*n*, and a terminal "c" connected to an input of each of the repair amplifiers 40-1 and 40-2**.

[Operation]

A test mode signal TEST is supplied to the testing pad 61. For example, when a signal level of the test mode signal TEST is in an inactive status, a normal mode (a first test mode) is conducted. In contrast, when the signal level of the test mode signal TEST is in an active status, a test mode (a second test mode) is conducted for testing the repair amplifiers 40-1 and 40-2.

In the normal mode, the terminals a and b are connected to each other at each of the switches 60-1 and 60-2. In other words, the output of the DAC 35 and the input of each of the amplifiers 36-1 and **36-*n* are connected to each other via each of the switches 60-1 and 60-2**.

For example, in the normal mode, the measurement equipment 53 tests an output delay of each of the amplifiers 36-1 to **36-*n* as an electric characteristics inspection. In this case, the probe card 54 inputs a drive signal (an output gray-scale voltage) to be supplied to output pads 56-1 to 56-*n* via the amplifiers 36-1 to 36-*n* in accordance with an output switch by the DAC 35, and then, outputs the drive signal to the tester 55. The tester 55 tests the output delays of the amplifiers 36-1 to 36-*n*** based on the drive signal, and then, judges a quality based on an output delay time representing the output delay.

In the test mode, the terminals a and c are connected to each other at each of the switches 60-1 and 60-2. In other words, the output of the DAC 35 is connected to the input of each of the repair amplifiers 40-1 and 40-2 instead of the inputs of the amplifiers 36-1 and **36-*n* via each of the switches 60-1 and 60-2**.

For example, in the test mode, the measurement equipment 53 tests the output delay of each of the repair amplifiers 40-1 and 40-2. In this case, the probe card 54 inputs a drive signal (an output gray-scale voltage) to be supplied to repairing output pads 52-1 and 52-2 via the repair amplifiers 40-1 and 40-2 in accordance with an output switch by the DAC 35, and then, outputs the drive signal to the tester 55. The tester 55 tests the output delays of the repair amplifiers 40-1 and 40-2 based on the signal, and then, judges a quality based on an output delay time representing the output delay.

[Effect]

As described above, the switches 60-1 and 60-2 supply the drive signals (the output gray-scale voltages) to the inputs of the repair amplifiers 40-1 and 40-2 when the test mode (the second test mode) is conducted in the data driver 30 of the TFT type liquid crystal display device 1 according to a first embodiment of the present invention. As a consequence, the amplitude value of an analog voltage (the output gray-scale voltage) equivalent to that of the test of the output delay of each of the n amplifiers 36-1 to **36-*n* in the normal amplifier circuit 36 is inputted into the inputs of the repair amplifiers 40-1 and 40-2. Therefore, the outputs of the repair amplifiers 40-1 and 40-2 can be subjected to a test equivalent to that of the output delay of each of the n amplifiers 36-1 to 36-*n*. Thus, it is possible to precisely determine the quality based on the output delays of the repair amplifier 40-1 and 40-2 by using a mass-produced LSI tester 55**.

(Second Embodiment)

[Configuration]

Figure 7:
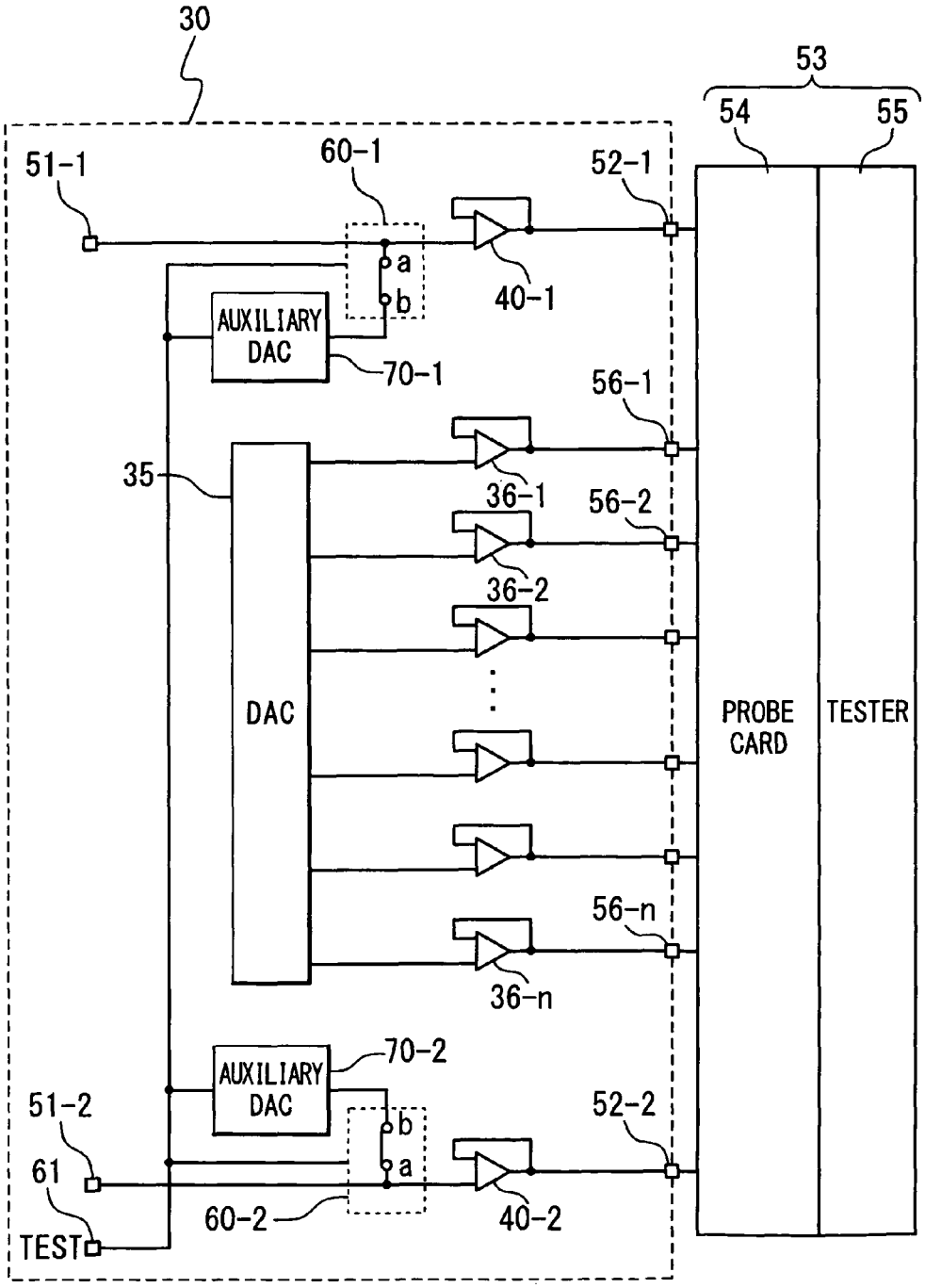
FIG. 7 illustrates a data driver 30 and measurement equipment 53, which is connected to the data driver 30 and includes a probe card 54 and a tester 55 according to a second embodiment.

FIG. 7 illustrates a configuration of the data driver 30 of a TFT type liquid crystal display device 1 according to a second embodiment of the present invention and measurement equipment 53 which is connected to the data driver 30 and includes the probe card 54 and the tester 55. The data driver 30 is provided with switches 60-1 and 60-2, a testing pad 61 and auxiliary DACs 70-1 and 70-2. The switches 60-1 and 60-2, the testing pad 61 and the auxiliary DACs 70-1 and 70-2 are mounted on a chip. The measurement equipment 53 including the probe card 54 and the tester 55 is connected to the chip when an electric characteristics inspection is conducted.

The testing pad 61 is connected to the switches 60-1 and 60-2 and the auxiliary DACs 70-1 and 70-2 via wirings. Repair amplifiers 40-1 and 40-2 are disposed in respective vicinities of amplifiers 36-1 and **36-*n*, in an amplifier circuit 36 inside of the data driver 30. The switches 60-1 and 60-2 are interposed between the auxiliary DACs 70-1 and 70-2 and the repair amplifiers 40-1 and 40-2, respectively. Each of the switches 60-1 and 60-2 includes a terminal "a" connected to the input of each of the repair amplifiers 40-1 and 40-2 and a terminal "b" connected to the output of each of the auxiliary DACs 70-1 and 70-2**.

Each of the auxiliary DACs 70-1 and 70-2 is a circuit of one output of the DAC 35. When a test mode (a second test mode) for testing the repair amplifiers 40-1 and 40-2 is conducted, each of the auxiliary DACs 70-1 and 70-2 outputs a drive signal (an output gray-scale voltage) being same to the output of the DAC 35.

[Operation]

The test mode signal TEST is supplied to the testing pad 61. For example, when a signal level of the test mode signal TEST is in an inactive status, a normal mode (a first test mode) is conducted. In contrast, when a signal level of the test mode signal TEST is in an active status, a test (a second test mode) is conducted.

In the normal mode, the terminals a and b are disconnected from each other at each of the switches 60-1 and 60-2. In other words, the outputs of the auxiliary DACs 70-1 and 70-2 and the inputs of the repair amplifiers 40-1 and 40-2 are not connected to each other, respectively, via each of the switches 60-1 and 60-2.

For example, in the normal mode, the measurement equipment 53 tests an output delay of each of the n amplifiers 36-1 to **36-*n* in the amplifier circuit 36 as an electric characteristics inspection. In this case, the probe card 54 inputs a drive signal (an output gray-scale voltage) to be supplied to output pads 56-1 to 56-*n* via the n amplifiers 36-1 to 36-*n* in accordance with the output switch by the DAC 35, and then, outputs the drive signal to the tester 55. The tester 55 tests the output delays of the amplifiers 36-1 to 36-*n*** based on the drive signal, and then, determines a quality based on an output delay time representing the output delay.

In the test mode, the terminals a and b are connected to each other at each of the switches 60-1 and 60-2. In other words, the outputs of the auxiliary DACs 70-1 and 70-2 and the inputs of the repair amplifiers 40-1 and 40-2 are connected to each other, respectively, via each of the switches 60-1 and 60-2.

For example, in the test mode, the measurement equipment 53 tests the output delay of each of the repair amplifiers 40-1 and 40-2. In this case, the probe card 54 inputs a drive signal (an output gray-scale voltage) to be supplied to repairing output pads 52-1 and 52-2 via the repair amplifiers 40-1 and 40-2 in accordance with an output switch by each of the auxiliary DACs 70-1 and 70-2, and then, outputs the drive signal to the tester 55. The tester 55 tests the output delays of the repair amplifiers 40-1 and 40-2 based on the signal, and then, judges a quality based on an output delay time representing the output delay.

[Effect]

As described above, in the data driver 30 in the TFT type liquid crystal display device 1 of a second embodiment according to the present invention, the switches 60-1 and 60-2 supply the drive signals (the output gray-scale voltages) to the inputs of the repair amplifiers 40-1 and 40-2 when the test mode (the second test mode) is conducted, as in a first embodiment. As a consequence, an amplitude value of an analog voltage (the output gray-scale voltage) equivalent to that of the test of the output delay of each of the n amplifiers 36-1 to **36-*n* in the normal amplifier circuit 36 is inputted into the inputs of the repair amplifiers 40-1 and 40-2. Therefore, the outputs of the repair amplifiers 40-1 and 40-2 can be subjected to a test equivalent to that of the output delay of each of the n amplifiers 36-1 to 36-*n*. Thus, it is possible to precisely determine the quality based on the output delays of the repair amplifier 40-1 and 40-2 by using a mass-produced LSI tester 55**.

(Third Embodiment)

[Configuration]

Figure 8:
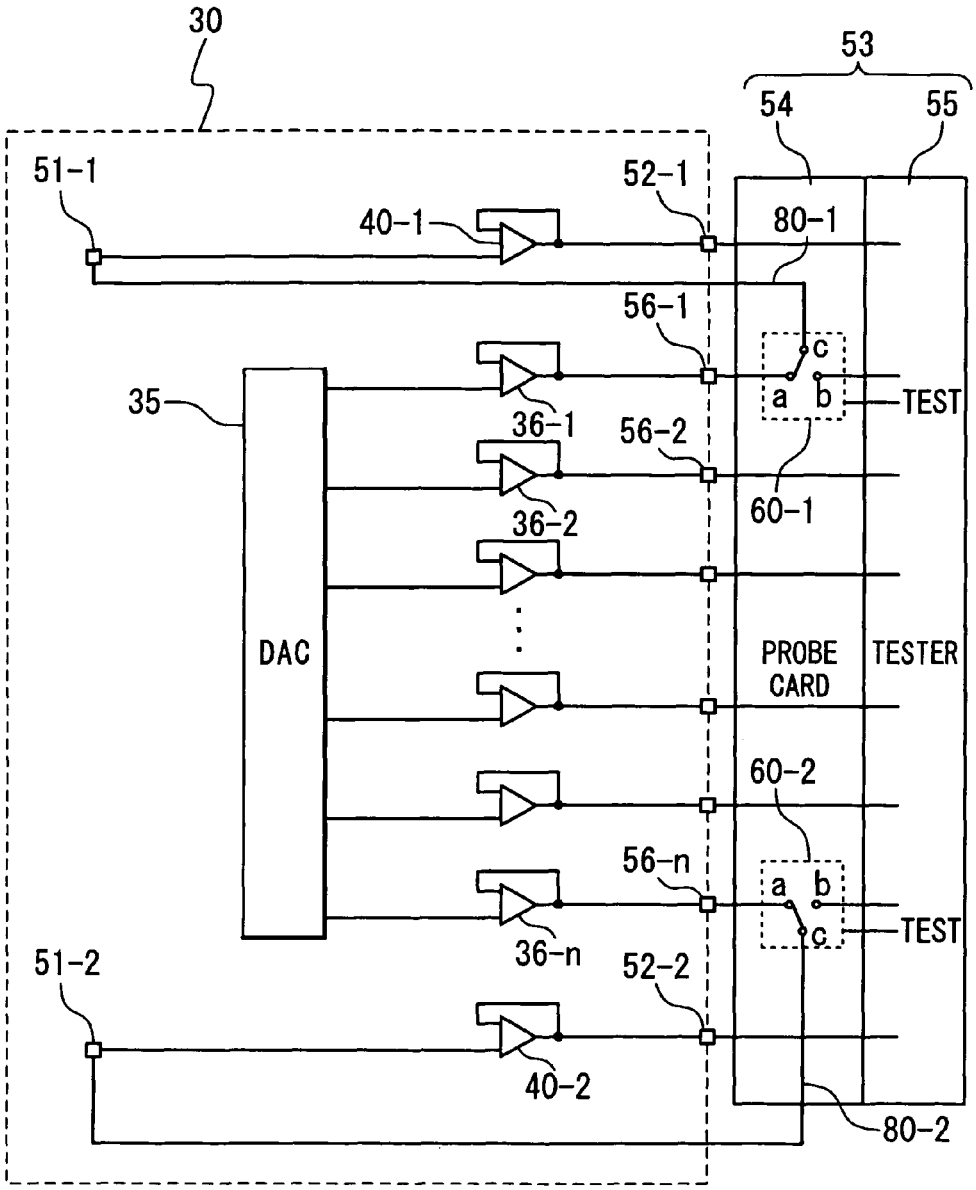
FIG. 8 illustrates a data driver 30 and measurement equipment 53, which is connected to the data driver 30 and includes a probe card 54 and a tester 55 according to a third embodiment.

FIG. 8 illustrates a configuration of a data driver 30 in a TFT type liquid crystal display device 1 and measurement equipment 53, which is connected to the data driver 30 and includes the probe card 54 and the tester 55, according to a third embodiment of the present invention. The measurement equipment 53 including the probe card 54 and the tester 55 is connected to the chip when an electric characteristics inspection is conducted. The probe card 54 includes switches 60-1 and 60-2 and testing wirings 80-1 and 80-2.

Repair amplifiers 40-1 and 40-2 are disposed in respective vicinities of amplifiers 36-1 and **36-*n* in an amplifier circuit 36 inside of the data driver 30. The switches 60-1 and 60-2 are interposed between output pads 56-1 and 56-*n* and the tester 55, respectively, on the probe card 54. Each of the switches 60-1 and 60-2 includes a terminal "a" connected to an output of each of the output pads 56-1 and 56-*n*, a terminal "b" connected to the tester 55, and a terminal "c" connected to each of the testing wirings 80-1 and 80-2**.

[Operation]

The test mode signal TEST is supplied to the switches 60-1 and 60-2 from the tester 55. For example, when a signal level of the test mode signal TEST is in an inactive status, a normal mode (a first test mode) is conducted. In contrast, when a signal level of the test mode signal TEST is in an active status, a test mode (a second test mode) is conducted.

In the normal mode, the terminals a and b are connected to each other at each of the switches 60-1 and 60-2. In other words, the output pads 56-1 and **56-*n* and the tester 55 are connected to each other on the probe card 54 via each of the switches 60-1 and 60-2**.

For example, in the normal mode, the measurement equipment 53 tests an output delay of each of the n amplifiers 36-1 to **36-*n* in the amplifier circuit 36 as an electric characteristics inspection. In this case, the probe card 54 inputs a drive signal (an output gray-scale voltage) to be supplied to the output pads 56-1 to 56-*n* via the n amplifiers 36-1 to 36-*n* in accordance with the output switch by the DAC 35, and then, outputs the drive signal to the tester 55. The tester 55 tests the output delays of the amplifiers 36-1 to 36-*n*** based on the drive signal, and then, judges a quality based on an output delay time representing the output delay.

In the test mode, the terminals a and c are connected to each other at each of the switches 60-1 and 60-2. In other words, the output pads 56-1 and **56-*n* are connected to the repairing input pads 51-1 and 51-2 via the testing wirings 80-1 and 80-2, respectively, instead of connected to the tester 55**.

For example, in the test mode, the measurement equipment 53 tests the output delay of each of the repair amplifiers 40-1 and 40-2. In this case, the probe card 54 inputs a drive signal (an output gray-scale voltage) to be supplied to repairing output pads 52-1 and 52-2 via the repair amplifiers 40-1 and 40-2 in accordance with an output switch by the DAC 35, and then, outputs the drive signal to the tester 55. The tester 55 tests the output delays of the repair amplifiers 40-1 and 40-2 based on the signal, and then, judges a quality based on an output delay time representing the output delay.

[Effect]

As described above, the switches 60-1 and 60-2 supply the drive signals (the output gray-scale voltages) to the inputs of the repair amplifiers 40-1 and 40-2 when the test mode (the second test mode) is conducted in the probe card 54 according to a third embodiment of the present invention, like in first and second embodiments. As a consequence, the amplitude value of an analog voltage (the output gray-scale voltage) equivalent to that of the test of the output delay of each of the n amplifiers 36-1 to **36-*n* in the normal amplifier 36 is inputted into the inputs of the repair amplifiers 40-1 and 40-2. Therefore, the outputs of the repair amplifiers 40-1 and 40-2 can be subjected to a test equivalent to that of the output delay of each of the n amplifiers 36-1 to 36-*n*. Thus, it is possible to precisely determine the quality based on the output delay of the repair amplifier 40-1 and 40-2 by using a mass-produced LSI tester 55**.

Additionally, neither switch nor test terminal is required to be disposed in the data driver 30 in a third embodiment of the present invention. Therefore, it is possible to reduce a chip layout area in the data driver 30 compared with first and second embodiments.

Although the present invention has been described above in connection with several embodiments thereof, it would be apparent to those skilled in the art that those exemplary embodiments are provided solely for illustrating the present invention, and should not be relied upon to construe the appended claims in a limiting sense.

What is claimed is:

1. A data driver of a display device, the data driver comprising:

a DAC (Digital Analog Converter) comprising an output to output a drive signal for driving a signal line of a displaying unit;

an amplifier configured to amplify the drive signal outputted by the DAC, the amplifier comprising an output to output the drive signal that has been amplified by the amplifier to the signal line;

a repair amplifier comprising an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line; and a switch configured to supply the drive signal to the input of the repair amplifier when a test mode for testing the repair amplifier is performed wherein the switch comprises:

a first terminal connected to the output of the DAC;

a second terminal connected to the input of the amplifier; and a third terminal connected to the input of the repair amplifier.

2. The data driver of the display device according to claim 1, wherein the switch connects the output of the DAC and an input of the amplifier for inputting the drive signal outputted by the DAC in a normal mode, and the switch disconnects the output of the DAC and the input of the amplifier, and connects the output of the DAC and the input of the repair amplifier in response to a test mode signal for performing the test mode.

3. The data driver of the display device according to claim 1, further comprising:

an auxiliary DAC configured to output an output signal comprising the drive signal in response to a test mode signal for performing the test mode, wherein the switch disconnects the output of the auxiliary DAC and the input of the repair amplifier in a normal mode, and connects the output of the auxiliary DAC and the input of the repair amplifier in response to the test mode signal.

4. The data driver of a display device according to claim 3, wherein the drive signal voltage being input into the input of the repair amplifier has an amplitude that is equivalent to an amplitude of the test mode signal.

5. The data driver of a display device according to claim 1, wherein when the test mode for testing the repair amplifier is performed the drive signal input into the input of the repair amplifier has an amplitude that is equivalent to an amplitude of the drive signal input into the input of the amplifier in a normal mode.

6. The data driver of a display device according to claim 1, wherein the switch connects the first terminal and the second terminal in a normal mode and connects the first terminal and the third terminal in the test mode.

7. The data driver of a display device according to claim 1, wherein the switch comprises a single pole double throw switch.

8. The data driver of a display device according to claim 7, wherein the single pole double throw switch comprises a common terminal being connected to the output of the DAC.

9. The data driver of a display device according to claim 1, wherein the switch is one of a plurality of switches including a second switch.

10. The data driver of a display device according to claim 9, wherein the repair amplifier is one of a plurality of repair amplifiers including a second repair amplifier.

11. The data driver of a display device according to claim 10, wherein, when the test mode is performed, the second switch supplies the drive signal to an input of the second repair amplifier.

12. The data driver of a display device according to claim 1, wherein the amplifier is one of a plurality of amplifiers each configured to amplify the drive signal output by the DAC, and to output the drive signal that has been amplified to a respective signal line.

13. A test method for testing a data driver of a display device, wherein the display device includes:

a DAC (Digital Analog Converter) configured to have an output to output a drive signal for driving a signal line of a displaying unit;

an amplifier configured to amplify the drive signal outputted by the DAC, the amplifier comprising an output to output the drive signal that has been amplified by the amplifier to the signal line; and a repair amplifier comprising an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line, a switch configured to supply the drive signal to the input of the repair amplifier when a test mode for testing the repair amplifier is performed, wherein the switch comprises:

a first terminal connected to an output of an auxiliary DAC, and a second terminal connected to the input of the repair amplifier, the test method comprising:

connecting measurement equipment to the data driver based on an input to the input of the repair amplifier before performing a test mode for testing the repair amplifier; and supplying the drive signal to the input of the repair amplifier when the test mode is performed.

14. The data driver of a display device according to claim 13, wherein the DAC is one of a plurality of DACs including a first auxiliary DAC being configured to receive a test signal that initiates the test mode for testing the repair amplifier.

15. The data driver of a display device according to claim 14, wherein the plurality of DACs further includes a second auxiliary DAC being configured to receive the test signal and to be connected to a second repair amplifier.

16. The data driver of a display device according to claim 15, wherein the switch is one of a plurality of switches including a second switch configured to supply the drive signal to an input of the second repair amplifier, and wherein the first auxiliary DAC comprises an output to connected to the switch and the second auxiliary DAC comprises an output connected to the second switch.

17. The data driver of a display device according to claim 15, wherein, when the testing mode is performed, the first auxiliary DAC is electrically connected to the input of the repair amplifier and the second auxiliary DAC is electrically connected to an input of the second repair amplifier.

18. A probe card designed to be applied to a test of a data driver of a display device, wherein the data driver includes:

a DAC (Digital Analog Converter) configured to have an output to output a drive signal for driving a signal line of a displaying unit;

an amplifier configured to amplify the drive signal outputted by the DAC, the amplifier comprising an output to output the drive signal that has been amplified by the amplifier to the signal line; and a repair amplifier comprising an input and an output, wherein the signal line is separated into a connected data line connected to the amplifier and a disconnected data line not connected to the amplifier by a breakage point when a breakage occurs on the signal line, and the input of the repair amplifier is connected to the connected data line and the output of the repair amplifier is connected to the disconnected data line, the probe card comprising:

a plurality of wirings including a testing wiring; and a switch configured to:

connect the data driver and a tester for performing the test, connect an output of the amplifier and the tester to supply a signal from the output of the amplifier to the tester in a normal mode of the test; and disconnect the output of the amplifier and the tester, connect the output of the amplifier and the input of the repair amplifier to supply a signal of the output of the repair amplifier based on the drive signal to the tester in a test mode of the test wherein the switch comprises:

a first terminal connected to the output of the amplifier;

a second terminal connected to a tester; and a third terminal connected to the input of the repair amplifier.

19. The probe card designed to be applied to a test of a data driver of a display device according to claim 18, wherein the switch comprises a common terminal that is electrically connected to the output of the amplifier when the probe card is applied to the data drive.

* * * * *